US006216313B1

(12) United States Patent
Leach, II et al.

(10) Patent No.: US 6,216,313 B1
(45) Date of Patent: Apr. 17, 2001

(54) HANDLE WITH INTEGRAL CORD WRAP

(75) Inventors: Walter W. Leach, II; Frank H. Stephan, II; Rodney D. Maddox, all of Fenton, MO (US)

(73) Assignee: Rug Doctor, L.P., Plano, TX (US)

( * ) Notice: Subject to any disclaimer, the term of this patent is extended or adjusted under 35 U.S.C. 154(b) by 0 days.

(21) Appl. No.: 09/575,017

(22) Filed: May 19, 2000

(51) Int. Cl.[7] ..... A47L 9/32
(52) U.S. Cl. ..... 15/323; 15/320; 15/410
(58) Field of Search ..... 15/323, 410, 320

(56) References Cited

U.S. PATENT DOCUMENTS

| | | | | |
|---|---|---|---|---|
| D. 364,947 | | 12/1995 | Kent et al. . | |
| 3,204,272 | * | 9/1965 | Greene et al. | 15/323 X |
| 3,284,837 | * | 11/1966 | Waters et al. | 15/323 X |
| 3,667,084 | * | 6/1972 | Valbona et al. | 15/410 X |
| 3,939,527 | | 2/1976 | Jones . | |
| 4,129,920 | * | 12/1978 | Evans et al. | 15/410 X |
| 4,222,145 | * | 9/1980 | Lowder | 15/323 X |
| 4,720,890 | | 1/1988 | Jacob . | |
| 5,473,792 | | 12/1995 | Kent et al. . | |
| 5,513,415 | | 5/1996 | Kent et al. . | |
| 5,839,159 | | 11/1998 | Karr et al. . | |
| 5,850,666 | | 12/1998 | Farone et al. . | |
| 5,887,315 | | 3/1999 | Rogers . | |
| 5,933,912 | | 8/1999 | Karr et al. . | |
| 6,079,080 | * | 6/2000 | Rutter et al. | 15/410 |
| 6,106,182 | * | 8/2000 | Hamm et al. | 15/410 X |

FOREIGN PATENT DOCUMENTS

| | | | | |
|---|---|---|---|---|
| 62985 | * | 3/1994 | (JP) | 15/410 |

* cited by examiner

*Primary Examiner*—Chris K. Moore
(74) *Attorney, Agent, or Firm*—Grace J. Fishel

(57) ABSTRACT

A tubular plastic handle for a steam cleaning machine with a T-shaped hollow member to which is integrally attached a hollow outrigger supported on hollow posts. The posts provide an integral cord wrap and the outrigger improves flexural rigidity. The hollow member also includes an aperture further improving flexural rigidity through which a linkage controlling the angle of the handle may be accessed.

10 Claims, 4 Drawing Sheets

HANDLE WITH INTEGRAL CORD WRAP

BACKGROUND OF THE INVENTION

1. Field of the Invention

The present invention relates to an improved hollow, tubular handle for a steam cleaning machine with an integral cord wrap, which design improves the flexural strength of the handle.

2. Brief Description of the Prior Art

The design of tubular plastic handles for steam cleaning machines, particularly those used by consumers, are motivated by a desire to make the machine as light as possible. Tubular plastic handles for such machines, however, may be lacking in flexural rigidity.

Light weight shell structures may be strengthened with metal parts. Metal clips can also be attached to the handle to provide a cord wrap but such metal parts add expense to the fabrication of a handle because the parts themselves cost money and because additional labor is required for the assembly of the handle. Second, metal parts may become loose over time, decreasing the dependability and strength of the handle. And third, set screws or the like that attach the metal parts and protrude inside the handle may cause an electrical hazard because the fasteners could damage the electrical wires inside the handle.

BRIEF SUMMARY OF THE INVENTION

In view of the above, it is an object of the present invention to provide a light weight tubular plastic handle for a steam cleaner with an integral cord wrap that improves the flexural strength of the handle without the addition of metal parts other than bushings. It is another object to provide such a handle wherein the bushings may be rotationally molded with the handle. Other objects and features of the invention will be in part apparent and in part pointed out hereinafter.

In accordance with the present invention, a handle for a steam cleaner having a support housing has a hollow tubular member with a flat front and rear face. The tubular member has a longitudinal axis and is T-shaped in longitudinal cross-section with a stem and a cross bar. The cross bar is attached to a first end of the stem and has a pair of grips on opposite sides of the stem. The stem widens towards a second end and is bifurcated into a pair of branches which are adapted to be journaled to the main support housing of the cleaner.

The hollow tubular member has an integrally formed tubular outrigger connected by a pair of hollow posts, lying in the same plane as the hollow tubular member and forming a closed loop with the hollow tubular member. The outrigger provides an integral cord wrap while the closed loop that the outrigger and posts make with the hollow tubular member increases the flexural rigidity of the handle along the longitudinal axis of the hollow tubular member.

A linkage is provided for controlling the angle of the handle with respect to the support housing. Preferably hollow tubular member has an aperture adjacent its bifurcated end providing a second loop increasing the flexural rigidity of the handle. The aperture in the hollow tubular member also permits access to a pin threaded on a rod, under the control of a lever within fingertip reach of the crossbar, forming the linkage for controlling the angle of the handle. Preferably the pin is reciprocated in a bushing integrally molded with the handle. Integrally molded bushings may also be provided in the branches of the tubular member, about which the handle is journaled.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
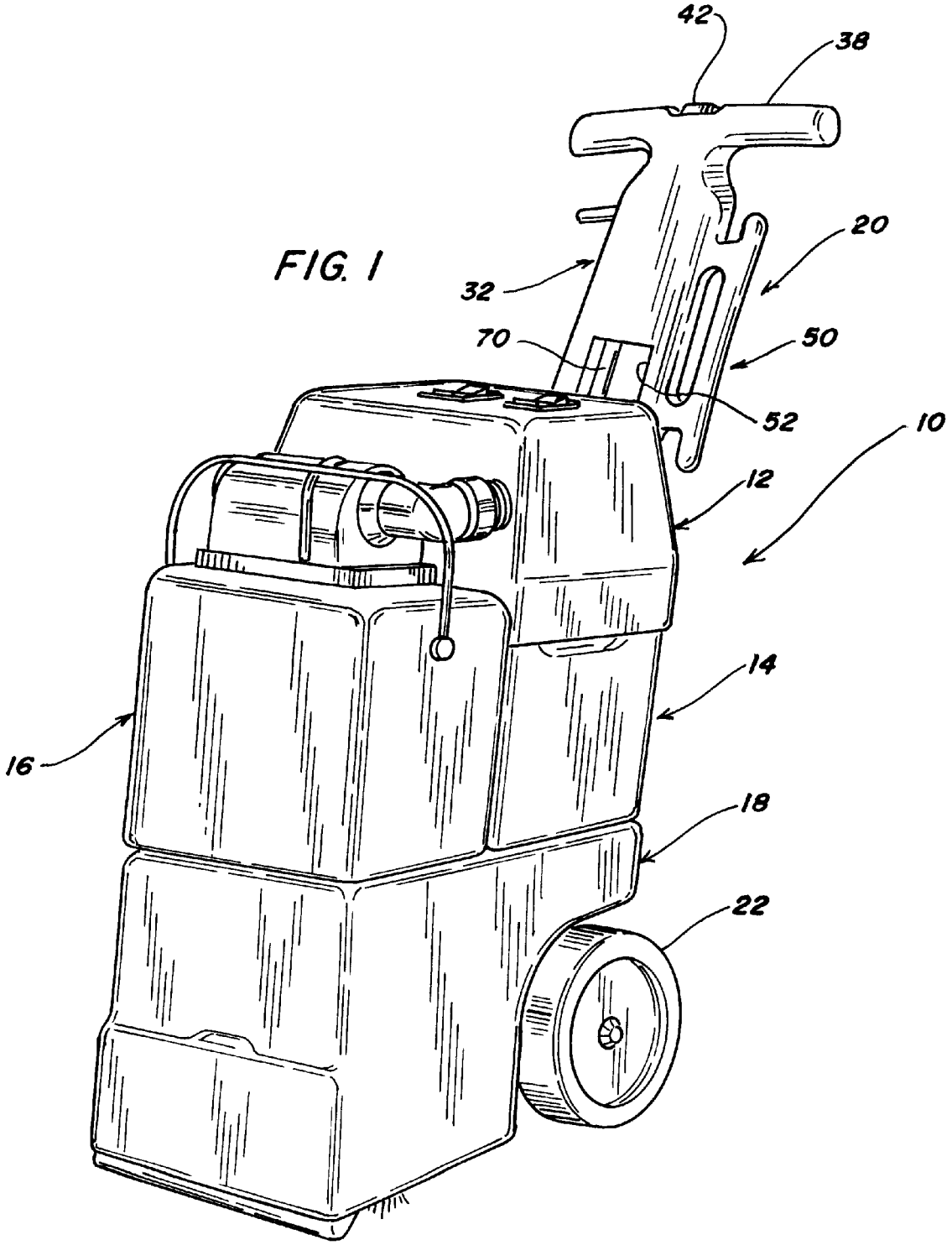
FIG. 1 is a perspective view of a steam cleaning machine with a handle in accordance with the present invention.

Referring to the drawings more particularly by reference character, starting with FIG. 1, reference numeral 10 refers to a portable self-contained carpet steam cleaning machine. Steam cleaner 10 includes, vertically stacked, a vacuum head 12 mounted on a main support housing 14, a removable waste recovery tank 16 slidable in and out of the main support housing and a bottom clean water tank 18 upon which the main support housing and waste recovery tank are mounted. A handle 20 in accordance with the present invention is pivotally attached to main support housing 14 at the rear of the machine for moving the machine on a pair of wheels 22 attached to the underside of clean water tank 18, which in addition to serving as a reservoir for premixed cleaning solution, serves as a chassis for the machine.

Figure 2:
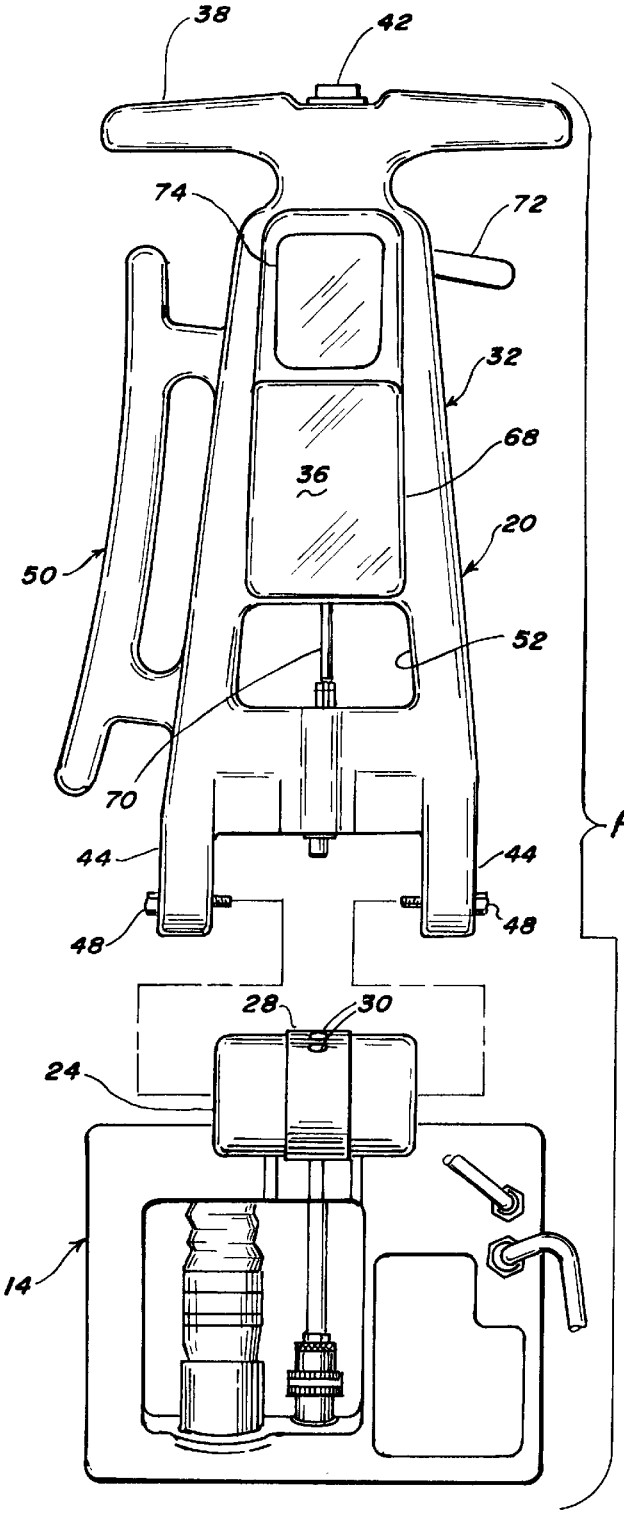
FIG. 2 is an exploded rear elevation of the handle and a main support housing of the steam cleaning machine.
Figure 3:
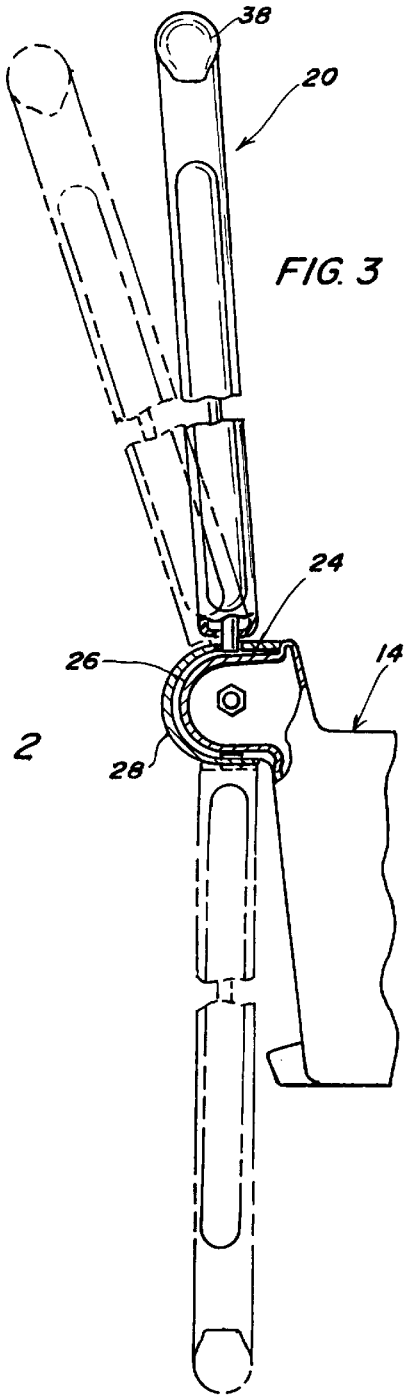
FIG. 3 is a fragmentary side elevation of the handle in three of various possible positions.

As shown in FIGS. 2 and 3, main support housing 14 has a cylinder 24 along its top rear edge. A groove 26 is formed in cylinder 24 midway the length thereof, about which is wrapped a plate 28 with a plurality of spaced apart apertures 30. Plate 28 serves as a ferrule protecting the cylinder from wear.

Figure 4:
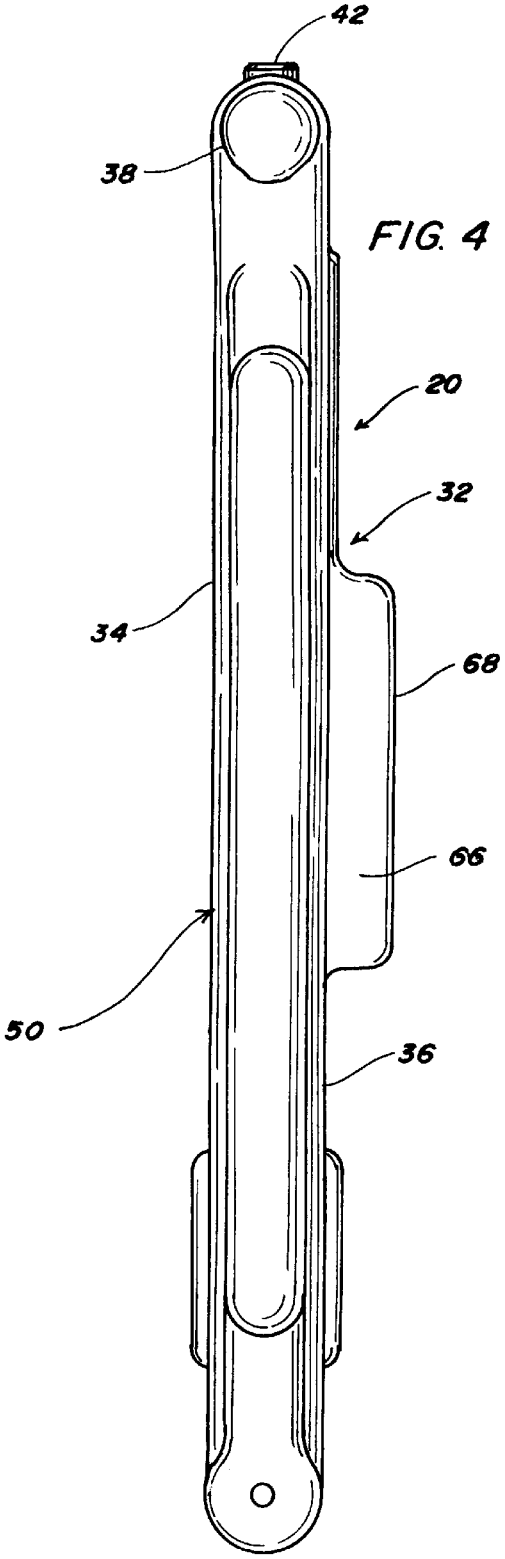
FIG. 4 is a left side elevation of the handle.
Figure 5:
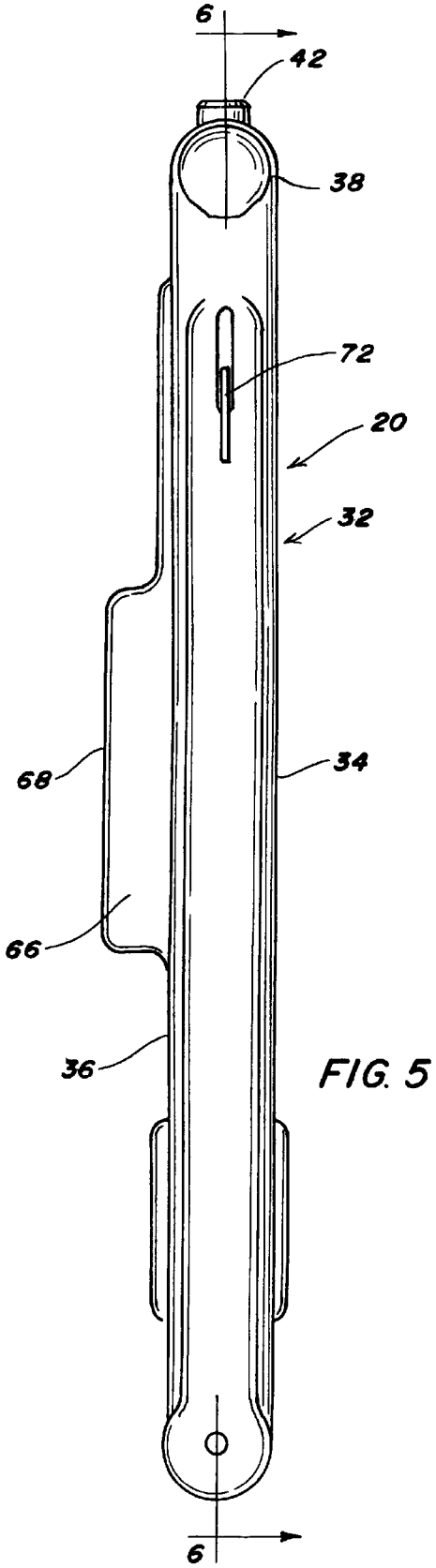
FIG. 5 is a right side elevation of the handle.
Figure 6:
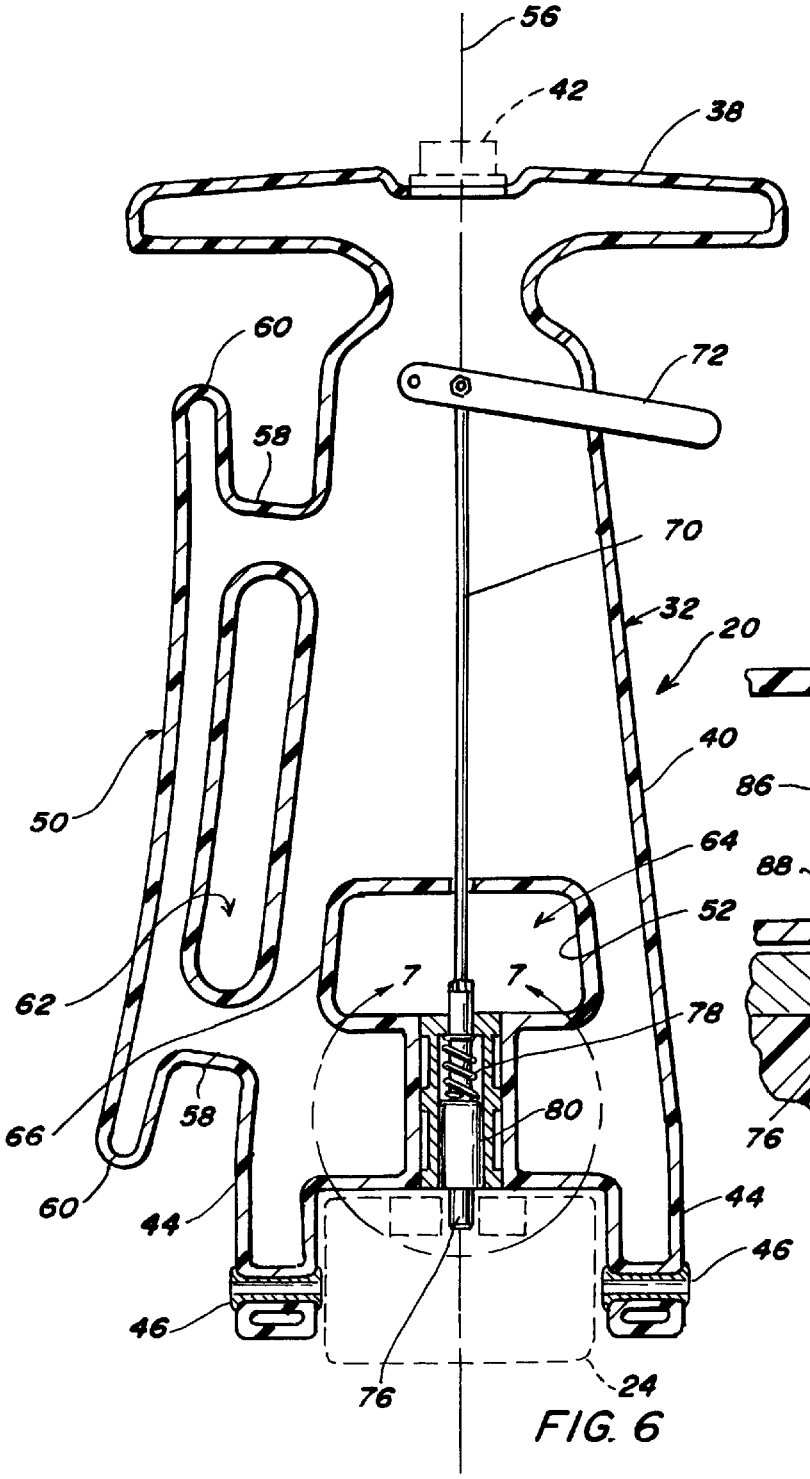
FIG. 6 is a section taken along line 6—6 in FIG. 5; and, FIG. 7 is a detail taken along line 7—7 in FIG. 6.

Referring now to FIGS. 4–6, it is seen that handle 20 is a hollow tubular member 32 with generally flat front and rear faces 34, 36, respectively. Tubular member 32 is T-shaped in longitudinal cross-section with a crossbar 38 mounted at one end of a stem 40 with the crossbar forming a pair of grips on opposite sides of the stem. The grips are ergonomic and preferably taper toward the ends because of the foreshortening of an operator's fingers and the cross-section of the grip perpendicular to a longitudinal axis of crossbar 38 is preferably oval to accommodate a variety of hand sizes. A switch 42 for activating a water pump/brush motor (not shown) is provided at the center of crossbar 38 for right and left handed reach. An internal wiring harness (not shown) provides electrical connections between switch 42 and the water pump/brush motor. Stem 40 widens and is bifurcated at its opposite end forming branches 44 with bushings 46 journaled about a pair of bolts 48 attached to the ends of cylinder 24.

Handle 20, thus far described, is similar to the handle described in U.S. Pat. No. 5,513,415 except as to the location of switch 42 and as to bushings 46 which may be integrally molded with hollow tubular member 32 as more particularly described below or may be inserted post molding. Handle 20 differs, however, in the provision of an outrigger 50 and an aperture 52 at its widened end. Outrigger 50 is a hollow tube, generally parallel to a longitudinal axis 56 of hollow tubular member 32 and is connected to the hollow tubular member by a pair of spaced apart hollow posts 58. Posts 58 are spaced adjacent the ends of outrigger 50, with the free ends of the tube forming horns 60 for use as a cord. Outrigger 50 and posts 58 are integrally molded in the same plane with hollow tubular member 32 and with member 32 form a first loop 62. Aperture 52 has sidewalls normal to front and rear faces 34, 36 of tubular member 32 and forms a second loop 64 in handle 20.

Flexural rigidity is a measure of an object's resistance to bending and is proportional to the object's (1) moment of inertia about an axis and (2) material stiffness. Applied to handle 20, the moment of inertia about longitudinal axis 56 is increased by wall components parallel to the normal direction of bending, such as the walls around first and second closed loops 62, 64 and vertical walls 66 around a boot 68 provided on rear face 36. The rigidity of the handle is increased by these wall components with height "h" because of their effect on deflection, as illustrated by the formula for deflection in a rectangular beam, supported at both ends, with a single load in the middle: $3lW/2fh^2$, where l=length, W=load and f=stress.

Figure 7:
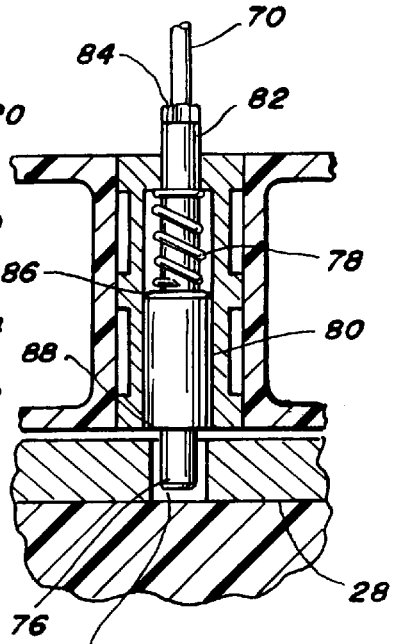

Handle 20 has a rod 70 attached near crossbar 38 to a lever 72, one end of which is within fingertip reach of the right grip and the other end of which is pivoted in stem 40 about an axis normal to front and rear faces 34, 36. An access door 74 is provided in rear face 36 through which lever 72 and the upper end of rod 70 may be accessed for connection to the pivot. An opposite end of rod 70 ends with a pin 76 which is received in one of apertures 30 in plate 28. Rod 70 is biased with a spring 78, the details of which are shown in FIGS. 6 and 7, such that pin 76 is extended except when lever 72 is pulled up. Depending on the arrangement of apertures 30, handle 20 can be adjusted between a vertically up and a vertically down position, and at selected angles ergonomic to the operator therebetween as shown in FIG. 3.

Pin 76 as shown in FIGS. 6 and 7, is received in a bushing 80 which is preferably molded in handle 20. An upper end of pin 76 is threaded for attachment to rod 70. Within limits, the effective length of pin 76 with respect to plate 28 may be adjusted by threading pin 76 more or less on rod 70, for which purpose pin 76 may have flats 82 such that it can be gripped with a wrench. This feature is advantageous during assembly of the machine and for maintenance. Once pin 76 has been threaded on the rod to a desired extent, it may be fixed with a locking nut 84. In the embodiment shown in the drawings, pin 76 increases in diameter below its upper end providing an abutment shoulder 86 between which and a bottom of bushing 80, spring 78 is compressed. As shown in FIG. 7, pin 76 is received in a selected aperture 30 in plate 28, with the enlarged bottom of the pin providing a second abutment shoulder 88 in contact with plate 28, locking handle 20 in a selected position. In other embodiments, pin 76 may terminate in a blade which is wedged into aperture 30 in plate 28 or the like.

Hollow handle 20 with bushings 46 and 80 may be rotationally molded as an integral unit from plastic. This feature improves structural integrity and manufacturing efficiency. A preferred material for handle 20 is high density polyethylene (HDPE) but other thermoplastics, including copolymers, may be used. Boot 68 provides a space in the mold for granulated HDPE at the beginning of the molding process, in addition to increasing the flexural rigidity of the finished handle. Boot 68 is advantageous since handle 20 contains many narrow passageways. After hollow tubular member 32 with outrigger 50 is molded, lever 72, rod 70 and pin 76 are assembled through access door 74 and aperture 52, respectively. Handle 20 can then be journaled on main support housing 14 with bolts 48. The power cord (not shown) for steam cleaning machine 10 may be wrapped around posts 58, under horns 60. Since outrigger 50 is integrally molded with tubular member 32, the cord wrap does not loosen with use.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A handle for a steam cleaner having a support housing, said handle comprising a hollow tubular member having a flat front and rear face, said tubular member having a longitudinal axis and being T-shaped in longitudinal cross-section with a stem and a cross bar, said cross bar attached to a first end of the stem and having a pair of grips on opposite sides of the stem, said stem widening towards a second end of the stem and bifurcated into a pair of branches which are adapted to be journaled to the support housing of the cleaner, said hollow tubular member having an integrally formed tubular outrigger connected by a pair of hollow posts, said outrigger and posts lying in the same plane as the hollow tubular member and forming a closed loop with the hollow tubular member, whereby the outrigger provides an integral cord wrap and the closed loop increases the flexural rigidity of the handle along the longitudinal axis of the hollow tubular member.

2. The handle of claim 1 wherein the stem of the hollow tubular member has an aperture adjacent the bifurcated second end, said aperture forming a second closed loop which further increases the flexural rigidity of the handle along the longitudinal axis of the hollow tubular member.

3. The handle of claim 2 with a molded-in bushing in the stem at the bifurcated second end within which a pin is reciprocated, said pin attached to a rod connected to a lever within fingertip reach of the crossbar and receivable in an aperture of a plate attached to the support housing, said pin biased into engagement with the plate by a spring.

4. The handle of claim 3 wherein the pin is threaded on the rod and secured in a selected threaded position on the rod with a lock nut.

5. A rotationally molded handle for a steam cleaner having a support housing, said handle comprising a hollow tubular member having a flat front and rear face, said rear face including a boot, said tubular member having a longitudinal axis and being T-shaped in longitudinal cross-section with a stem and a cross bar, said cross bar attached to a first end of the stem and having a pair of grips on opposite sides of the stem, said stem widening towards a second end of the stem and bifurcated into a pair of branches which are adapted to be journaled to the support housing of the cleaner, said stem having a molded-in bushing at the bifurcated second end, said hollow tubular member having an integrally formed tubular outrigger connected by a pair of hollow posts, said outrigger and posts lying in the same plane as the hollow tubular member and forming a closed loop with the hollow tubular member, whereby the outrigger provides an integral cord wrap and the closed loop increases the flexural rigidity of the handle along the longitudinal axis of the hollow tubular member.

6. The handle of claim 5 wherein the stem of the hollow tubular member has an aperture adjacent the bifurcated second end, said aperture forming a second closed loop which further increases the flexural rigidity of the handle along the longitudinal axis of the hollow tubular member.

7. The handle of claim 6 wherein a pin is reciprocated in the bushing in the stem, said pin attached to a rod connected to a lever within fingertip reach of the crossbar and receivable in an aperture of a plate attached to the support housing, said pin biased into engagement with the plate by a spring.

8. The handle of claim 7 wherein the pin is threaded on the rod and secured in a selected threaded position on the rod with a lock nut.

9. The handle of claim 5 wherein the journaled branches have molded-in bushings.

10. The handle of claim 5 formed of high density polypropylene.

* * * * *